United States Patent [19]

Sniadoch

[11] Patent Number: 5,041,367

[45] Date of Patent: Aug. 20, 1991

[54] PHOTOGRAPHIC RECORDING MATERIAL

[75] Inventor: Henry J. Sniadoch, Canandaigua, N.Y.

[73] Assignee: Eastman Kodak Company, Rochester, N.Y.

[21] Appl. No.: 488,553

[22] Filed: Mar. 5, 1990

[51] Int. Cl.[5] ..... G03C 1/295; G03C 1/34

[52] U.S. Cl. ..... 430/603; 430/544; 430/611; 430/629

[58] Field of Search ..... 430/603, 611, 629, 544

[56] References Cited

U.S. PATENT DOCUMENTS

| | | | |
|---|---|---|---|
| 3,038,805 | 6/1962 | Dann et al. | 430/550 |
| 3,046,129 | 7/1962 | Graham et al. | 96/55 |
| 3,046,132 | 7/1962 | Minsk | 96/108 |
| 3,495,981 | 2/1970 | Nagae et al. | 430/372 |
| 3,730,724 | 5/1973 | Abbott | 430/505 |
| 3,813,247 | 5/1974 | Minsk et al. | 430/627 |
| 4,292,400 | 9/1981 | Pollet et al. | 430/383 |
| 4,610,954 | 9/1986 | Torigoe et al. | 430/445 |
| 4,849,324 | 7/1989 | Aida et al. | 430/445 |
| 4,920,043 | 4/1990 | Ohashi et al. | 430/611 |
| 4,956,260 | 9/1990 | Nakamura | 430/138 |

*Primary Examiner*—Charles L. Bowers, Jr.
*Assistant Examiner*—Janis L. Dote
*Attorney, Agent, or Firm*—Paul L. Marshall

[57] ABSTRACT

A photographic recording material is provided which has enhanced photographic properties, such as sharpness values without substantial decrease in photographic speed.

7 Claims, No Drawings

PHOTOGRAPHIC RECORDING MATERIAL

This invention relates to a photographic recording material having improved properties. More particularly this invention describes improved sharpness and enhanced interlayer interimage effects without experiencing speed losses.

Interimage is a term used to describe effects which occur when development in one layer has effects on another layer. For example, where development in one layer causes either inhibition or acceleration of development in another layer.

Development accelerator compounds are well known. They are effective for increasing the speed of photographic recording materials. Such compounds include, for example, oxathioethers of the type described in U.S. Pat. Nos. 3,038,805 and 4,292,400. Development accelerators also include polyoxyethylene alkylphenyl ether compounds as described in U.S. Pat. No. 3,495,981. These ether compounds are stated to be especially useful when incorporated in a p-phenylenediamine containing developer solution.

U.S. Pat. No. 3,813,247 describes nondiffusible polyester condensation products which are useful as development accelerators for color photographic products. These polyesters can be incorporated in melts containing silver halide emulsions. However, known development accelerators suffer from problems which include too high a rate of diffusibility when incorporated in a photographic recording material as well as tendencies to cause fog and contrast increases.

Development inhibitors are also well known in the art. These are frequently utilized in photographic recording materials for the purpose of preventing prolonged development and can induce intralayer and interlayer image effects which can enhance color and sharpness.

U.S. Pat. No. 3,730,724 describes development inhibitor compounds which are suitable for use in this invention. These compounds include carboxy-substituted thiazolinethiones and thiazolidines including particularly the compound 4-carboxy-methyl-4-thiazoline-2-thione (hereinafter called CMTT). These compounds also act as stabilizing agents to prevent fog formation and thereby improve both shelf life stability and post process dye stability in color photographic recording materials. However, problems encountered with such carboxy substituted compounds include loss of photographic speed and also decreased contrast in color images.

Problems are frequently encountered in the photographic art when attempts are made to enhance the properties of photographic recording materials. Such problems frequently offset advantages otherwise expected.

The object of the present invention is to provide a combination of a development accelerator compound with a development inhibitor compound in order to achieve enhanced photographic properties, such as sharpness, without a substantial decrease in photographic speed.

This invention overcomes such problems by simultaneously incorporating a development accelerator compound with a development inhibitor compound in a photographic recording material. Speed losses normally observed are minimized while both color and sharpness values are enhanced.

The present invention provides a photographic recording material comprising a support and a photosensitive silver halide emulsion layer having in reactive association therewith a polymeric development accelerator compound having the structural formula:

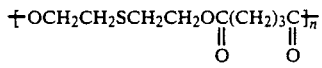

I and a development inhibitor compound comprising a 5- or 6- member heterocyclic ring having the structural formula:

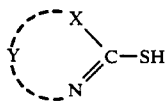

II wherein:

n is from about 4 to about 40;

X is sulfur or nitrogen and

Y is a 2 or 3 member alkylene group which can be substituted.

Substituents which can be present on the 2 or 3 member alkylene group include alkyl having 1 to 3 carbon atoms, carboxy (—COOH), hydroxy substituted alkyl and carboxy substituted alkyl. Preferred substituents include hydroxymethyl and carboxymethyl groups.

Typical development inhibitor compounds which fall within formula II include:

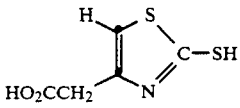

D1-1

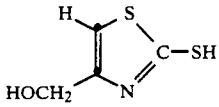

D1-2

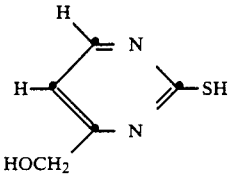

D1-3

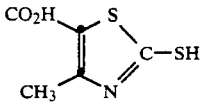

D1-4

Such compounds are well known in the art so that their preparation is well documented in the chemical literature.

Development inhibitors as described above are known to induce intralayer as well as interlayer image effects which are beneficial for enhancing both color and sharpness. However, use of such compounds causes loss of photographic speed and also reduced contrast.

The amount of development inhibitor compound which can be used with this invention is from about 5 to about 90 mg/mole of silver. A preferred amount is from about 11 to about 33 mg/mole of silver in order to maximize desired sharpness values.

The development accelerator compound which can be used in combination with development inhibitors of this invention to achieve improved photographic results has as is noted above, the formula:

$$-O(CH_2CH_2SCH_2CH_2\underset{\underset{O}{\|}}{O}C(CH_2)_3\underset{\underset{O}{\|}}{C})_n$$

and is commonly referred to as "Lanothane".

As can be seen from the above formula "Lanothane" is polymeric and includes segments containing both thioether and carboxylic groups. The molecular weight range for this polymeric material is between about 1,000 and about 10,000, with a preferred molecular weight ranging from about 3,000 to about 6,000.

The development accelerator compound can be used in an amount of from about 15 to about 1300 mg/mole of silver, with a preferred concentration from about 30 to about 800 mg/mole silver. Use of the preferred ranges of both molecular weight and concentration of development accelerator compound provides a favorable blend of both speed and sharpness values.

Where the amount of development inhibitor compound is relatively high it is preferred that the concentration of development accelerator compound also be relatively high in order to achieve a maximum of desired results.

The development accelerator and development inhibitor compounds can be added to a layer comprising silver halide or to a layer adjacent thereto, for example to a gelatin interlayer. If desired, one of the compounds can be added to a silver halide layer and the other to an adjacent layer. A significant feature is that these compounds can be located either in a silver halide layer or in a layer adjacent to the silver halide so long as the compounds are in reactive association with each other.

The term "in reactive association" as used herein is intended to mean that the compounds can be in either the same or different layers, so long as they are accessible to one another and to silver halide grains contained in a photosensitive layer.

As is demonstrated in the following examples, when both materials are employed sharpness enhancements and other desirable effects are observed which are not obtained when these materials are separately employed.

The practice of this invention is possible in single color or in multicolor photographic recording materials. The layers of the recording materials, including the layers of separate image-forming units, can be arranged in various orders as is known in the art. In a preferred embodiment, a recording material of this invention is a multicolor photographic material comprising a support having thereon at least one red-sensitive silver halide emulsion layer having associated therewith a cyan dye image-forming coupler compound, at least one green sensitive silver halide emulsion layer having associated therewith a magenta dye image-forming coupler compound, and at least one blue-sensitive silver halide emulsion layer having associated therewith a yellow dye image-forming coupler compound.

The coupler compounds can be incorporated into, or associated with one or more layers of the recording material. The recording material can contain additional layers such as filter layers, interlayers, overcoat layers or subbing layers.

In the following discussion of suitable materials for use in the recording materials of this invention, reference will be made to *Research Disclosure*, Dec. 1978, Item 17643, published by Kenneth Mason Publications Ltd., Dudley Annex, 12a North Street, Emsworth, Hampshire, P010 7DQ England the disclosures of which are incorporated herein by reference. This publication will be identified hereafter by the term "Research Disclosure."

The silver halide emulsions employed in the recording materials of this invention can be either negative-working or positive-working. Suitable emulsions and their preparation are described in Research Disclosure Sections I and II, and the publications cited therein, and can include coarse, medium or fine grains or mixtures thereof. The grains may be of different morphologies, e.g., spherical; cubic, cubooctrahedral, tabular, etc. or mixtures thereof. Grain size distribution may be monodisperse or polydisperse or mixtures thereof. Such silver halides include silver chloride, silver bromide, silver bromoiodide, silver chlorobromide, silver chloroiodide, silver chlorobromoiodide and mixtures thereof. The emulsions can be negative or direct-positive working. They can form latent images predominantly on the surface of the silver halide grains or predominantly on the interior of the grains.

The emulsions may be chemically sensitized using sensitizers normally employed for chemically sensitizing silver halide grains. These include sulfur-containing compounds, for example allylisothiocyanates, allylthioureas and thiosulfates. Other suitable chemical sensitizers are noble metals or compounds thereof, such as gold, platinum, palladium, iridium, ruthenium or rhodium. The emulsions may also be sensitized with polyalkylene oxide derivatives. The method of chemical sensitization is described in an article by R. Koslowsky in *Z. Wiss. Phot.* 46, 65–72 (1951). Other methods of sensitization are described in Research Disclosure, Section III.

The emulsions may be optically sensitized in the known manner, for example with the usual polymethine dyes, such as merocyanines, basic or acidic carbocyanines, rhodacyanines, hemicyanines, styryl dyes, oxonols and the like. Sensitizers of these types are described by F. M. Hamer in *The Cyanine dyes and Related Compounds*, (1964). Particular reference in this connection is made to *Ullmanns Enzyklopadie der Technischen Chemie*, 4th Edition, Vol. 18, pages 431 et seq. and to Research Disclosure, Section IV.

The usual antifogging agents and stabilizers may be used. Particularly suitable stabilizers are azaindenes, preferably tetra- or penta-azaindenes, especially those substituted by hydroxyl or amino groups. Compounds such as these are described, for example, in Research Disclosure, Section IV.

The recording materials may contain stabilizers as protection against visible and UV light and for improving stability in storage prior to use. Particularly good stabilizers of this type are, for example, aminocallylidene malonitriles.

The additional constituents of the photographic material may be incorporated by known methods. If the compounds in question are water-soluble or alkali-soluble, they may be added in the form of aqueous solutions, optionally with addition of water-miscible organic solvents, such as ethanol, acetone or dimethyl formamide. If the compounds in question are insoluble in water and alkali, they may be incorporated in the recording materials in known manner in dispersed form. For example, a solution of these compounds in a low-boiling organic solvent may be directly mixed with the silver halide emulsion or first with an aqueous gelatin solution followed by removal of the organic solvent. The resulting dispersion of the particular compound may then be mixed with the silver halide emulsion. It is also possible to use so-called oil formers, generally relatively high boiling organic compounds which include the compounds to be dispersed in the form of oily droplets. In this connection, reference is made, for example, to U.S. Pat. Nos. 2,322,027, 2,533,514, 3,689,271, 3,764,336 and 3,764,797.

The usual layer supports may be used for the recording materials according to this invention. For example supports of cellulose esters, e.g. cellulose acetate, and of polyesters, e.g. poly(ethyleneterephthalate) can be used. Other suitable supports are paper supports which may optionally be coated, for example with polyolefins, more particularly with polyethylene or polypropylene. Reference is made in this connection to Research Disclosure No. 17643, Section XVII.

Suitable protective colloids or binders for the layers of the recording material are hydrophilic film-forming agents, for example proteins, more especially gelatin. Casting aids and plasticizers may be used. Reference is made in this connection to the compounds mentioned in the above-cited Research Disclosure Sections IX, XI and XII.

The layers of the photographic materials may be hardened in the usual way, for example with hardeners from Research Disclosure Section XI.

The described photographic recording materials can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and to oxidize the color developing agent. Oxidized color developing agent in turn reacts with the coupler to yield a dye.

Suitable color developers for the material according to the invention are, in particular, those of the p-phenylene diamine type, for example 4-amino-N,N-diethylaniline hydrochloride; 4-amino-3-methyl-N-ethyl-N-β-(methanesulfonamido)ethylaniline sulfate hydrate; 4-amino-3-methyl-N-ethyl-N-β-hydroxyethylaniline sulfate; 4-amino-N-ethyl-N-(2-methoxyethyl)-m-toluidine di-p-toluenesulfonic acid and N-ethyl-N-β-hydroxyethyl-p-phenylene diamine. Other suitable color developers are described, for example, in J. Amer. Chem. Soc. 73, 3100 (1951) and in G. Haist, *Modern Photographic Processing,* 1979, John Wiley and Sons, New York, pages 545 et seq.

After color development, the material is bleached and fixed in the usual way. Bleaching and fixing may be carried out either separately from, or together with, one another. Suitable bleaches include for example Fe (III) salts and Fe (III) complex salts, such as ferricyanides; dichromates; and water-soluble cobalt complexes etc. Particularly suitable bleaches are iron (III) complexes of aminopolycarboxylic acids; ethylenediaminetetraacetic acid; nitrilotriacetic acid; iminodiacetic acid, N-hydroxyethylethylenediaminetriacetic acid; alkyliminodicarboxylic acids and the corresponding phosphonic acids. Other suitable bleaches are persulfates.

The following specific examples will serve as further illustrations of this invention.

EXAMPLE 1

The effects of separate use of the development accelerator compound Lanothane, of a development inhibiting compound, and of combinations of both types of compounds are illustrated in Table 1. Each coating comprised the indicated concentration of Lanothane and of the development inhibitor compound D1-1 as identified above. Each coating also comprised the following concentrations which are given in mg/m$^2$ and silver halide is expressed as silver:

a. Subbing layer: gelatin—4887 b. Emulsion layer: gelatin—2154, green sensitive silver bromoiodide (4.8% iodide)—808 and the indicated addenda

TABLE I

| Example | Amt. (mg/mole Ag) Lanothane | D1-1 | Rel. Speed[1] | CMT Sharpness[2] |
|---|---|---|---|---|
| 1 Control | 0 | 0 | 123 | 97.7 |
| 2 Control | 0 | 22.1 | 122 | 98.6 |
| 3 Control | 0 | 44.2 | 118 | 98.6 |
| 4 Control | 0 | 88.4 | 122 | 97.9 |
| 5 Control | 352.8 | 0 | 142 | 97.9 |
| 6 Invn. | " | 22.1 | 132 | 99.9 |
| 7 Invn. | " | 44.2 | 129 | 98.8 |
| 8 Invn. | " | 88.4 | 121 | 99.6 |
| 9 Control | 705.6 | 0 | 155 | 96.7 |
| 10 Invn. | " | 22.1 | 139 | 100.6 |
| 11 Invn. | " | 44.2 | 137 | 99.8 |
| 12 Invn. | " | 88.4 | 128 | 99.7 |
| 13 Control | 1058.4 | 0 | 159 | 96.2 |
| 14 Invn. | " | 22.1 | 145 | 100.6 |
| 15 Invn. | " | 44.2 | 139 | 99.8 |
| 16 Invn. | " | 88.4 | 127 | 100.5 |

[1]Strips of these coatins were step-exposed to white light and processed in an E-6 process as described in the British Journal of Photography Annual 1988, pages 194–196 (which is hereby incorporated herein by reference). Relative photographic speed was measured as 100 times the relative log exposure providing a reversal image dye density of 1.0.

[2]Sharpness was calculated using the following formula in which the cascaded area under the sytem modulation curve is shown in equation (21.104) on p. 629 of The Theory of the Photographic Process, 4th Edition, 1977, edited by T. H. James (which is incorporated herein by reference): CMT = 100 + 42 log [cascaded area/5.4782M], where the magnification factor M = 3.36 (35 mm slide). The use of CMT acutance is described by R. G. Gendron in "An Improved Objective Method for Rating Picture Sharpness: CMT Acutance" in the Journal of the SMPTEM Vol. 82, pp. 1009–12 (1973), which is incorporated herein by reference.

As can be seen from Table I a combination of the development accelerator lanothane with a development inhibitor compound causes an increase in sharpness over a wide range of values with gains in photographic speed, especially at lower concentrations of development inhibitor.

EXAMPLE 2

Sharpness and speed improvements were demonstrated in a monochrome element comprising the following layers coated on a film support with carbon antihalation backing. All component concentrations are given in mg/m$^2$ and silver halide is expressed as silver:

a. Subbing layer: gelatin—4887.

b. Emulsion layer: gelatin—2154, red-sensitized silver bromoiodide (6.4% iodide) emulsion—808, cyan dye-forming coupler—1291, and the addenda indicated in Table 1.

c. Protective layer: gelatin—2154 and bis(vinylsulfonyl)methane hardener at 1.55% of total gelatin.

Cyan Coupler

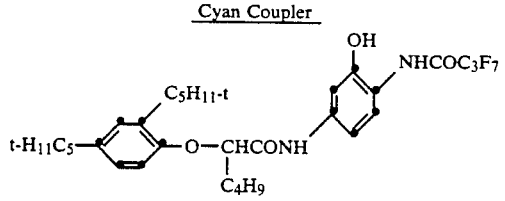

Strips of these coatings were step-exposed to white light and processed in an E-6 process as described in the British Journal of Photography Annual 1988, pages 194–196. Relative photographic speed was measured as 100 times the relative—log exposure providing a reversal image dye density of 1.0.

Sharpness was calculated as explained above.

TABLE 2

| Example | Amt. (mg/mole Ag) Lanothane | D1-1 | Rel. Speed | CMT Sharpness |
|---|---|---|---|---|
| Control | 0 | 0 | 167 | 96.8 |
| " | 0 | 44.2 | 154 | 96.4 |
| " | 529.2 | 0 | 196 | 96.7 |
| Invention | 529.2 | 44.2 | 169 | 97.7 |
| " | 882.0 | 44.2 | 173 | 98.4 |
| " | 1234.8 | 44.2 | 178 | 98.9 |

The data in Table 2 show an unexpected synergistic action when the development accelerator Lanothane and the development inhibitor compound D1-1 are combined in a silver halide photographic recording material. Use of either of these addenda alone in this format, at varied concentrations, does not produce the sharpness improvements seen when both compounds are present. Increased sharpness values are obtained as the amounts of Lanothane are increased.

The invention has been described in detail with particular reference to preferred embodiments thereof, but it will be understood that variations and modifications can be effected within the spirit and scope of the invention.

I claim:

1. A photographic recording material comprising a support and a photosensitive silver halide emulsion layer having in reactive association therewith, about 30 to about 800 mg/mole of silver of a polymeric development accelerator compound having a molecular weight of from about 1000 to about 10,000 according to the structural formula:

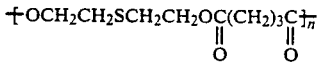

wherein n is from about 4 to about 40; and a development inhibitor compound comprising a 5-member heterocyclic ring having the structural formula:

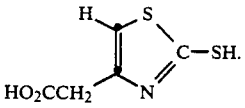

2. The recording material of claim 1 wherein the development inhibitor compound is present in an amount of from about 5 to about 95 mg/mole of silver.

3. The recording material of claim 2 wherein the development inhibitor compound is present in an amount of from about 11 to about 33 mg/mole of silver.

4. The recording material of claim 1 wherein the development accelerator has a molecular weight of from about 3,000 to about 6,000.

5. The recording material of claim 1 wherein the development inhibitor and the development accelerator compounds are present in a silver halide emulsion layer.

6. The recording material of claim 1 wherein one of the development inhibitor or development accelerator compounds is in a silver halide emulsion layer and the other is in an adjacent layer.

7. The recording material of claim 1 wherein the photographic material is multicolor.

* * * * *